US009810047B2

(12) United States Patent
Filyukov et al.

(10) Patent No.: US 9,810,047 B2
(45) Date of Patent: Nov. 7, 2017

(54) RE-FRACTURING BOTTOM HOLE ASSEMBLY AND METHOD

(71) Applicant: Baker Hughes Incorporated, Houston, TX (US)

(72) Inventors: Ruslan V. Filyukov, Midland, TX (US); Bryan J. Tindall, Beaumont, TX (US); Donald G. Parmer, Midland, TX (US)

(73) Assignee: BAKER HUGHES, Houston, TX (US)

( * ) Notice: Subject to any disclaimer, the term of this patent is extended or adjusted under 35 U.S.C. 154(b) by 771 days.

(21) Appl. No.: 14/010,055

(22) Filed: Aug. 26, 2013

(65) Prior Publication Data

US 2015/0053397 A1 Feb. 26, 2015

(51) Int. Cl.

| | |
|---|---|
| ***E21B 43/116*** | (2006.01) |
| ***E21B 33/124*** | (2006.01) |
| ***E21B 43/26*** | (2006.01) |
| *E21B 33/129* | (2006.01) |

(52) U.S. Cl.

CPC ..... *E21B 43/116* (2013.01); *E21B 33/124* (2013.01); *E21B 43/26* (2013.01); *E21B 33/129* (2013.01)

(58) Field of Classification Search

CPC ..... E21B 23/01; E21B 33/12; E21B 33/124; E21B 33/1243; E21B 33/1246; E21B 33/127; E21B 33/129; E21B 43/116

See application file for complete search history.

(56) References Cited

U.S. PATENT DOCUMENTS

| | | | | |
|---|---|---|---|---|
| 3,503,445 | A * | 3/1970 | Cochrum | E21B 21/103 166/151 |
| 4,665,977 | A * | 5/1987 | Mullins | E21B 33/1292 166/134 |
| 2005/0061508 | A1* | 3/2005 | Surjaatmadja | E21B 43/26 166/306 |
| 2005/0269083 | A1* | 12/2005 | Burris | E21B 23/00 166/255.2 |
| 2005/0279510 | A1* | 12/2005 | Patel | E21B 33/12 166/380 |
| 2006/0186602 | A1* | 8/2006 | Martin | E21B 17/07 277/338 |
| 2008/0066912 | A1* | 3/2008 | Freyer | E21B 33/1208 166/297 |

(Continued)

*Primary Examiner* — Robert E Fuller
*Assistant Examiner* — Christopher Sebesta
(74) *Attorney, Agent, or Firm* — Steve Rosenblatt

(57) ABSTRACT

A bottom hole assembly to enable reperforation and refracturing a cased hole has a bottom end anchor seal to allow a larger drift dimension in the zones to be perforated and fractured between spaced external seals that preferably set by swelling. A separable section has a seal bore to protect lower pressure rated casing in the upper annulus from overpressure during the refracturing operations. Either existing perforations can be refractured or new perforations made and fractured. With a multiple shot perforating gun all the zones can be perforated and fractured in a single trip with a service string that supports a releasable plug, a gun and frac ports. The BHA can be remove with a line cut above the anchor seal at the bottom and a pull on the tubular sting that takes all the swelling packers out. Location devices can be employed for proper gun placement before firing.

12 Claims, 1 Drawing Sheet

(56) References Cited

U.S. PATENT DOCUMENTS

| | | | | |
|---|---|---|---|---|
| 2008/0314591 | A1* | 12/2008 | Hales | E21B 33/12 166/285 |
| 2011/0209873 | A1* | 9/2011 | Stout | E21B 23/04 166/320 |
| 2012/0090847 | A1* | 4/2012 | Getzlaf | E21B 23/02 166/305.1 |
| 2013/0146287 | A1* | 6/2013 | Zhang | E21B 43/116 166/297 |
| 2013/0248192 | A1* | 9/2013 | Cook | E21B 33/127 166/308.1 |
| 2016/0245947 | A1 | 8/2016 | Clay et al. | |

* cited by examiner

RE-FRACTURING BOTTOM HOLE ASSEMBLY AND METHOD

FIELD OF THE INVENTION

The field of the invention is re-perforating and re-fracturing existing cased wells and more particularly a bottom hole assembly and method to get the refracturing done in a single trip in new perforations while providing a greater drift dimension to enhance fracturing flows at the desired delivery pressure.

BACKGROUND OF THE INVENTION

In the past wells would get sequentially perforated and fractured generally in an uphole direction. Already treated zones would be isolated as the next uphole zone would be perforated and then fractured. A production packer would be located above all the zones and the production tubing would be tagged into the production packer before the well would be put on production. At some point in time the production rate from the well would be unsatisfactory and typically the well would be plugged and abandoned.

Over time and as an alternative to plugging and abandoning the well it was thought to re-fracture the well but the presence of the production packer with its limited drift dimension through the mandrel inhibited the idea from taking hold. The reason was that the small drift would limit the size of the service string that could be used to run in the bridge plug and perforating gun that would then also be needed to perform the refracturing after the reperforating. It simply was not possible to pump at the frac rates needed of about 50 barrels a minute or more through small diameter tubing that could allow the bridge plug to clear the drift of the production packer mandrel. In essence the surface pumping horsepower requirements would be impractical or the working pressures and fluid velocities in the pumping system would be so high as to reach pipe working pressure limits or create serious erosion issues from high fluid velocities.

The present invention addresses these and other issues to enable the use of larger drift components to alleviate the drift issue that previously limited the frac service string size. Additional features are provided to isolate low pressure rated casing from overpressure during refracturing. Locating devices can be used to pinpoint the perforation locations. Using swellable packers reduces the running in drift of the assembly as well as making it possible to remove the swelling packers after cutting loose an anchor packer positioned below the lowest zone to be perforated and refractured. The frac ports in the service string are located close to the bridge plug to reduce the sand buildup on the barrier that isolates already treated zones from those to be treated. These and other features of the present invention will be more readily apparent to those skilled in the art from a review of the details of the preferred embodiment and the associated drawings while recognizing that the full scope of the invention is to be determined from the appended claims.

SUMMARY OF THE INVENTION

A bottom hole assembly to enable reperforation and refracturing a cased hole has a bottom end anchor seal to allow a larger drift dimension in the zones to be perforated and fractured between spaced external seals that preferably set by swelling. A separable section has a seal bore to protect lower pressure rated casing in the upper annulus from overpressure during the refracturing operations. Either existing perforations can be refractured or new perforations made and fractured. With a multiple shot perforating gun all the zones can be perforated and fractured in a single trip with a service string that supports a releasable plug, a gun and frac ports. The BHA can be remove with a line cut above the anchor seal at the bottom and a pull on the tubular sting that takes all the swelling packers out. Location devices can be employed for proper gun placement before firing.

DETAILED DESCRIPTION OF THE PREFERRED EMBODIMENT

Figure 1:
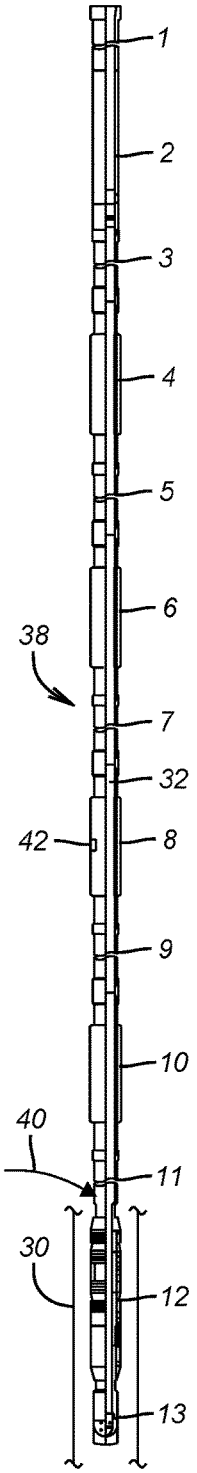
FIG. 1 is a bottom hole assembly that maximizes the size of the service string for reperforating and refracturing.

FIG. 1 shows a cased borehole represented schematically by casing 30 that had previously been producing through one or more zones and has come to the point in its life where it needs to be treated or recompleted to become viable in production. There may have been one or more zones that had been perforated and fractured in the past before the well was put on production. In the past the drift dimension of the casing 30 was the controlling variable in determining the size of another bottom hole assembly (BHA) that could be inserted therein and the drift of that BHA further limited a service string that would then have to be run inside the BHA for reperforating and refracturing in locations different from the existing perforations. These drift limitations meant that in some wells the available size of the service string would be so small due to drift limitations of the BHA through which a bridge plug on the service string would have to traverse that it would be impractical to later obtain a good frac job due to flow limitations, or the resultant power requirements or fluid velocities with regard to the service string.

The present invention addresses the limited drift issue in several ways. One way is to use swelling packers such as 4, 6, 8 and 10 that have a very low profile for run in before any swelling commences to allow a larger drift dimension internally at 32 for the passage of a service string shown in FIG. 5. The support anchor packer 12 and its associated seat 13 to catch an object such as a ball or a dart for setting against the casing 30 is located below the lowest perforation location 11. What this does is place the drift constriction at the lower end of the BHA shown in FIGS. 1-4 so that the service string 34 which includes the resettable bridge plug 36 can be a larger size than it otherwise would have been if it had to clear the drift dimension of the anchor packer 12.

Any number of intervals for perforating and fracturing can be defined between swelling packers such as 4, 6, 8 and 10 as denoted by sections of casing used as spacers 5, 7, 9 and 11. It should be noted that the swelling packer 10 need not be set when the zone 11 is being perforated and fractured because there are no other openings in the BHA 38 at the time that the first zone 11 is perforated.

In another advantage of the present invention the BHA 38 can be cut with a tubing cutter delivered on wireline and schematically represented by arrow 40. Because the anchor packer 12 is below the cut at 40, it does not have to be milled out and can be abandoned in the hole. The BHA 38 with the inflatable swelling packers such as 4, 6, 8 and 10 can simply be pulled out of the hole since the swelling packers such as 4, 6, 8 and 10 have no slips to anchor them and will readily release to a large enough pulling force on the string 1 to allow retrieval of the BHA 38 down to the cut location 40.

Figure 5:
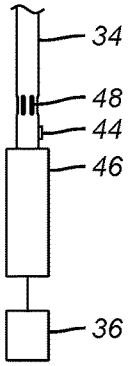
FIG. 5 is a schematic representation of the service string bottom hole assembly of a resettable bridge plug, a perforating gun(s) and the frac outlets that is run into the bottom hole assemblies of FIGS. 1-4.

The delivery string 1 has a releasable seal assembly 2 that has an upper component secured to the string 1 and a lower seal bore component secured to casing segment 3 below. After setting the anchor packer 12 at the desired location, the BHA 38 can be released with rotation or otherwise so that relative axial movement between the components of the assembly 2 can take place while seals on the uphole portion are still in the seal bore of the lower portion so that there is a signal to the surface that the running string 1 can be pulled clear out of the hole when the reperforating and refracturing of all the zones is complete. After removal of the upper component there is no reduction in drift at the seal bore when the service string of FIG. 5 is then run in.

The swelling packers such as 4, 6, 8 and 10 can each have location transmitters 42 whose signal is picked up with a receiver 44 located on the service string 34 for communication to the surface for proper placement of the perforating gun(s) 46 in each of the zones to be perforated.

It should be noted that assembly 2 with its seals in a seal bore even when released for relative axial movement isolates frac pressure applied through the sting 34 from reaching the annulus above the BHA 38 where there may be low pressure rated casing. Thus the frac pressure is contained by in the service string 34 until the flow exits through openings 48 that are placed as close as possible to the releasable bridge plug 36 so as to minimize sand accumulation above the bridge plug 36 during the frac job.

Figure 2:
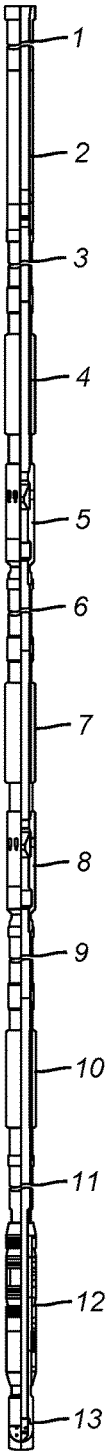
FIG. 2 is a variation of FIG. 1 that includes sliding sleeves for selective control of the source of production.
Figure 3:
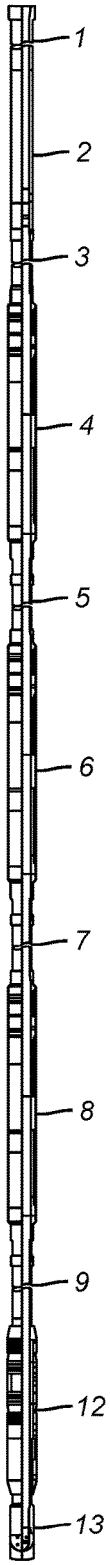
FIG. 3 is a variation of FIG. 1 using pressure set external isolators.
Figure 4:
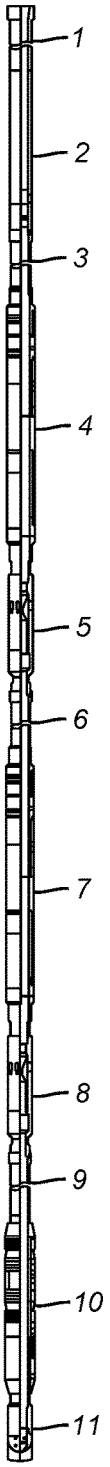
FIG. 4 is a variation of FIG. 3 that adds sliding sleeves for control of the location of subsequent production.

FIG. 2 shows sliding sleeves 5' and 7' that can be used in applications where existing perforations are refractured and later control of production is needed using the sliding sleeves that can be operated with a shifting tool. Optionally the external zone isolators can be other than swelling packers such as for example pressure set packers that are sequentially set with balls of increasing size. These are shown in FIG. 3 and can be combined with sliding sleeves as shown in FIG. 4. It should be noted that adding the sliding sleeves and the pressure set packers can reduce the available drift dimension for the tools on service string 34 as compared to the preferred embodiment of FIG. 1 where the swelling packers are used and the reperforation and refracturing takes place at different locations from the original perforations.

The gun 46 can be a single or multiple shot gun. In the case of a multiple shot gun that has as many shots as there are zones to reperforate, all the new perforated zones can be shot and fractured in a single trip into the BHA 38 with the service string 34.

The method includes running in the BHA 38 and setting the bottom end anchor packer 12. The assembly 2 can then be released such as with rotation so that it can still seal while giving a surface signal that it can be removed after the reperforating and refracturing of the zones in interest. The service string 34 supporting the equipment shown in FIG. 5 is run through the string 1 and the perforating gun is properly located using the location transmitters and sensors 42 and 44. The swelling packers such as 4, 6, 8 and 10 are allowed to or induced to swell and the reperforation and refracturing starts from the zone 11 and goes in an uphole direction. For zone 11 the bridge plug 36 need not be actuated since there are no lower exposed zones. Thereafter the string 34 is manipulated and the bridge plug 36 is set followed by reperforating and refracturing the just made perforations. The bridge plug 36 is released and the sting 34 manipulated to the next zone for a repeat of the process until all the zones are reperforated and refractured. The number of such zones can vary with the application. If the gun has enough shots the whole process can be finished with a single trip of string 34. The string 34 is removed including all the equipment supported at its lower end and the string 1 having been released at assembly 2 is also removed. A production string can then be run in to tag the seal bore of the assembly 2 that remains with the BHA 38. Production from all zones can then take place.

Those skilled in the art will appreciate the features of the apparatus and method of the invention that facilitate the ability to reperforate and refracture an existing cased hole. The lower end placement of the anchor packer 12 as well as the swelling packers such as 4, 6, 8 and 10 that have a low run in profile allow the drift dimension 32 in the BHA 38 to be maximized to make the refracturing realistically possible. The assembly 2 provides pressure protection to low pressure rated casing in the upper annulus as the refracturing is taking place. The position location feature allows for accurate positioning of the tools at the lower end of the service string 34 in each of the designated locations for reperforation and refracturing. The BHA 38 can be removed if cut at 40 and just pulled with string 1 because the anchor packer can be abandoned without needing to be milled out while the swelling packers offer minimal resistance to removal.

The swelling packers can be responsive to well fluids or added fluids and can be configured to swell at the same time or at staggered times. They can also be non-swelling and triggered with pressure or other means. Sliding sleeves can be an added feature for controlling the location of the production from either pre-existing perforations that have be refractured or new perforations that are made and then fractured.

The above description is illustrative of the preferred embodiment and many modifications may be made by those skilled in the art without departing from the invention whose scope is to be determined from the literal and equivalent scope of the claims below:

We claim:

1. A bottom hole assembly for cased hole recompletion in a borehole extending from a surface to a subterranean location, comprising:

spaced seals mounted externally to a tubular string support and defining at least one perforation and fracturing location there between;

an anchor seal for said tubular string mounted externally to said tubular string further from the surface than said spaced seals such that the drift dimension of said tubular string through said spaced seals is larger than through said anchor seal, said anchor seal selectively supporting said tubular string from the cased hole;

a service string supporting a service string bottom hole assembly further comprising at least one releasable plug below a perforating gun, a perforating gun with at least one shot and at least one fracturing port;

said service string bottom hole assembly when in the tubular string selectively positioned adjacent said at least one perforation and fracturing location for sequential perforation and fracturing with fluid flow through said port at said at least one location.

2. The assembly of claim 1, wherein:

said spaced seals actuate to contact the cased hole by swelling.

3. The assembly of claim 2, wherein:

said anchor seal sets with internal pressure in said tubular string.

4. The assembly of claim 2, wherein:

said spaced seals are removable from the cased hole with an axial force on said tubular string after said tubular string is released from said anchor seal.

5. The assembly of claim 4 wherein:

said releasing of said tubular string from said anchor seal is by severing said tubular string.

6. The assembly of claim 1, wherein:

said spaced seals actuate to contact the cased hole other than by swelling.

7. The assembly of claim 1, wherein:

said service string bottom hole assembly does not pass through said anchor seal to reach said at least one perforation and fracturing location.

8. The assembly of claim 7, wherein:

said spaced seals defining a plurality of perforation and fracturing locations between opposed pairs thereof;

said service string bottom hole assembly does not pass through said anchor seal to reach all said perforation and fracturing locations.

9. The assembly of claim 8, wherein:

at least one of said spaced seals has a location transmitter that communicates with a sensor on said service string bottom hole assembly for positioning said perforating gun in at least one said perforation and fracturing location.

10. The assembly of claim 8, wherein:

said perforating gun comprises multiple shots to allow all said perforation and fracturing locations to be perforated and fractured in a single trip of said service string bottom hole assembly.

11. The assembly of claim 1, further comprising:

at least one sliding sleeve located between said spaced seals to selectively provide access to the previously made perforations that have been refractured.

12. The assembly of claim 11, wherein:

said spaced seals actuate to contact the cased hole other than by swelling.

* * * * *